US009315740B2

(12) United States Patent
Balepin et al.

(10) Patent No.: US 9,315,740 B2
(45) Date of Patent: Apr. 19, 2016

(54) METHODS OF SEPARATING MIXTURES OF MISCIBLE FLUIDS

(71) Applicant: Alliant Techsystems Inc., Minneapolis, MN (US)

(72) Inventors: Vladimir Balepin, Manorville, NY (US); Jason S. Tyll, East Northport, NY (US); Florin Girlea, Sea Cliff, NY (US); Sabrina A. Hawkins, New York, NY (US)

(73) Assignee: Orbital ATK, Inc., Plymouth, MN (US)

( * ) Notice: Subject to any disclaimer, the term of this patent is extended or adjusted under 35 U.S.C. 154(b) by 278 days.

(21) Appl. No.: 13/793,816

(22) Filed: Mar. 11, 2013

(65) Prior Publication Data

US 2014/0166539 A1 Jun. 19, 2014

Related U.S. Application Data

(60) Provisional application No. 61/739,515, filed on Dec. 19, 2012.

(51) Int. Cl.

| | |
|---|---|
| ***C10G 31/10*** | (2006.01) |
| ***C10G 53/02*** | (2006.01) |
| ***C10G 31/06*** | (2006.01) |

(52) U.S. Cl.

CPC ..... *C10G 31/10* (2013.01); *C10G 31/06* (2013.01); *C10G 53/02* (2013.01); *C10G 2300/1051* (2013.01); *C10G 2300/202* (2013.01); *C10G 2400/08* (2013.01)

(58) Field of Classification Search

CPC ..... C10G 31/06; C10G 31/10; C10G 53/00; C10G 53/02

See application file for complete search history.

(56) References Cited

U.S. PATENT DOCUMENTS

| | | | | |
|---|---|---|---|---|
| 1,699,379 | A * | 1/1929 | Sperry | 208/177 |
| 1,952,281 | A | 3/1934 | Ranque | |
| 3,546,891 | A | 12/1970 | Fekete | |
| 4,151,073 | A * | 4/1979 | Comolli | 208/340 |
| 4,337,032 | A | 6/1982 | Duplouy et al. | |
| 4,354,852 | A * | 10/1982 | Kydd | 95/1 |
| 4,531,371 | A | 7/1985 | Voronin et al. | |
| 5,305,610 | A | 4/1994 | Bennett et al. | |
| 6,936,230 | B2 | 8/2005 | Zhurin et al. | |
| 7,303,598 | B1 | 12/2007 | Namazian et al. | |

OTHER PUBLICATIONS

Balepin et al., "Air Separation with the Vortex Tube: New Experimental Results," 8th International Space Planes and Hypersonic Systems and Technologies Conference, AIAA-98-1627, 6 pages (Apr. 27-30, 1998).

Bartholomew, C. H. and Farrauto, Robert J., "Fundamentals of Industrial Catalytic Processes," Wiley, John & Sons, Inc., Chapter 9 (2006), pp. 635-704.

Detail Specification, Turbine Fuel, Aviation, Kerosene Type, JP-8 (NATO F-34), NATO F-35, and JP-8+100 (NATO F-37) MIL-DTL-83133H w/Amendment 1, 25 pages (Sep. 14, 2012).

(Continued)

*Primary Examiner* — Renee E Robinson

(74) *Attorney, Agent, or Firm* — TraskBritt

(57) ABSTRACT

Disclosed herein are systems and methods for vortex tube desulfurization of jet fuels. Also disclosed are processes for separation of closely boiling species in a mixture of miscible fluids.

22 Claims, 4 Drawing Sheets

(56) References Cited

OTHER PUBLICATIONS

Hernandez-Maldonado et al., "New Sorbents for Desulfurization of Diesel Fuels via π-Completion," AIChE Journal, vol. 50, No. 4, pp. 791-801 (Apr. 2004).

Ma et al., "Deep Desulfurization of Diesel Fuels by a Novel Integrated Approach," Semiannual Technical Report for the Period Mar. 1-Aug. 31, 2001, Grant No. DE-FG26-00NT40821, 28 pages (Sep. 2001).

Ma et al., "Adsorptive desulfurization of JP-8 jet fuel and its light fraction over nickel-based adsorbents for fuel cell applications," Prepr. Pap.-Am. Chem. Soc., Div. Fuel Chem., vol. 48, No. 2, pp. 688-689 (2003).

McDougal et al., "Dermal Absorption of JP-8 Jet Fuel and its Components," Interim Report—May 1998-Mar. 1999, United States Air Force Research Laboratory, 27 pages (Mar. 1999).

Monitor Sulfur Compounds in Petroleum Chemical, Environmental, and Other Samples, Using a Special-Purpose Capillary GC Column, Bulletin 876A, Supelco, 16 pages (1998).

Selective Adsorption for Removing Sulfur for Making Ultra-Clean Transportation Fuels & for Fuel Cell Applications, Penn State, 2 pages (2011).

Song et al., "New design approaches to ultra-clean diesel fuels by deep desulfurization and deep aromatization," Applied Catalysis B: Environmental, vol. 41, Issues 1-2, pp. 207-238 (Mar. 10, 2003).

Sundararaman et al., "Oxidative Desulfurization of Jet and Diesel Fuels Using Hydroperoxide Generated in Situ by Catalytic Air Oxidation," Ind. Eng. Chem. Res., vol. 49, No. 12, pp. 5561-5568 (2010).

Velu et al., "Selective Adsorption for Removing Sulfur from Jet Fuel over Zeolite-Based Adsorbants." Ind. Eng. Chem. Res, vol. 42, No. 21, pp. 5293-5304 (2003).

Velu et al., "Zeolite-based Adsorbents for Desulfurization of Jet Fuel by Selective Adsorption," Fuel Chemistry Division Preprints, vol. 47, No. 2, pp. 447-448 (2002).

Velu et al., "Desulfurization of JP-8 Jet Fuel by Selective Adsorption over a Ni-based Adsorbant for Micro Solid Oxide Fuel Cells," Energy & Fuels, vol. 19, No. 3, pp. 1116-1125 (2005).

U.S. Agency for Toxic Substances and Disease Registry—Chemical and Physical Information, "Physical and Chemical Properties of Jet Fuels", www.atsdr.cdc.gov/toxprofiles/tp121-c3.pdf; JP-5 and JP-8, p. 102, Table 3-4, retrieved Apr. 14, 2015.

* cited by examiner

METHODS OF SEPARATING MIXTURES OF MISCIBLE FLUIDS

CROSS-REFERENCE TO RELATED APPLICATION

This application claims the benefit of U.S. Provisional Patent Application Ser. No. 61/739,515, filed Dec. 19, 2012, the disclosure of which is hereby incorporated herein in its entirety by this reference.

BACKGROUND

Fuel cells combine hydrogen and oxygen to produce electricity, and are quieter and more efficient than standard diesel generators. Currently available fuel cells typically utilize fuels such as hydrogen, methanol, or reformed natural gas. JP-8 is a common military jet fuel containing significant amounts of sulfur, which can poison the catalysts used in the fuel reformer and fuel cell. A convenient, efficient method for removal of sulfur compounds from JP-8 and other jet fuels such as Jet A is desirable, for example, for portable/mobile use in fuel cells.

Sulfur in hydrocarbon fuels is mainly present as polynuclear heterocyclic compounds. In conventional hydrodesulfurization (HDS) reactions, the most common industrial sulfur removal process, the sulfur compound benzothiophene and its derivatives are hydrogenated to thiophane derivatives before removal of the sulfur atom. Conventional HDS is catalyzed by promoted molybdenum sulfide, $MoS_2$. Thiols, sulfides, thiophenes and unsubstituted dibenzothiophenes (DBTs) are relatively rapidly converted by HDS. However, the substituted DBTs are less readily converted. C. H. Bartholomew and Robert J. Farrauto, "Fundamentals of Industrial Catalytic Processes," John Wiley & Sons, Inc., 2005.

Conventional hydrodesulfurization (HDS) is also capital and energy intensive. A typical industrial process of fuel HDS includes steps of 1) fuel compression to ~100 atmospheres and mixing with compressed hydrogen; 2) mixture preheating to ~350° C.; 3) exothermic reaction in three reactors with increasingly higher surface area; 4) heat removal; 5) processing in a high pressure separator in which light gases, e.g., $H_2$, $H_2S$, and low-molecular-weight hydrocarbons are removed; 6) liquid scrubbing from $H_2S$ and low-molecular-weight hydrocarbons in a low pressure separator; and 7) hydrogen recovery from byproduct and recycling. Bartholomew et al., 2005. Nevertheless, the concentration of sulfur compounds in hydrocarbon fuels must be reduced by more than 95%, requiring "deep desulfurization," to meet the present requirements for fuel sulfur content, and/or meet $SO_2$ emissions standards.

Therefore, a convenient, efficient, alternative method for removal of sulfur compounds from hydrocarbon fuels is desirable for mobile and portable applications, as well as stationary applications such as at an oil refinery.

Various alternative methods to HDS for hydrocarbon fuel desulfurization have been disclosed.

Distillation is one conventional method for separating two or more liquid compounds on the basis of boiling-point differences. Distillation does not extract pure compound, especially if boiling points of the target compounds are close. Fractional distillation, which is also referred to as "rectification," is a much more efficient separation process, which is the basis of many industrial processes including oil refinery and air separation. In addition, some closely boiling miscible fluid mixtures can form an azeotrope (constant boiling mixture), which requires addition of an entrainer for efficient separation by distillation processes.

Namazian et al., U.S. Pat. No. 7,303,598, Dec. 4, 2007, disclose a process for fractionating hydrocarbon fuel into light and heavy fractions in a fuel preprocessor (FPP). The light fraction is optionally further desulfurized by adsorption in an organic sulfur trap (OST), or by a hydrodesulfurizer step, and then reformulated in a steam reformer into a reformed fuel appropriate for use in fuel cells. Namazian Table 2 illustrates that by removing 30% heavy ends from JP-8 fuel by fractionation, the amount of sulfur is reduced by 50% to 371 ppm with 45% loss of polyaromatics. Disadvantages of fractionation by FPP include the need for fuel reformulation, loss of significant amount of fuel as heavy ends, and moderate ability to remove sulfur.

Ma et al. used adsorptive desulfurization of JP-8 jet fuel and its light fraction over nickel-based adsorbents for fuel-cell applications. However, this technique is limited by adsorbent capacity. See Ma et al., "Adsorptive desulfurization of JP-8 jet fuel and its light fraction over nickel-based adsorbants for fuel cell applications," Prep. Pap, *Am. Chem. Soc. Div. Fuel Chem.* 2003, 48(2), 688.

Velu et al. used various zeolite-based adsorbants for removing sulfur from jet fuel, but this technique is also limited by finite sulfur adsorption capacities and selectivity for sulfur compounds compared to aromatics. Velu et al., *Ind. Eng. Chem. Res.* 2003, 42, 5293-5304.

Given the limitations of prior art methods, there is need for an efficient fuel desulfurization method that allows sulfur removal without significant fuel reformulation, substantially reduces capital and operational expenses associated with stationary fuel desulfurization, and permits portable and mobile fuel desulfurization applications.

An alternative technical approach utilizing vortex tube separation of mixtures of miscible liquids is provided herein. The vortex tube approach is applicable to removal of sulfur compounds from hydrocarbon fuels, and more broadly applicable to any process that requires separation of fluids with close boiling temperature.

Use of vortex tubes is proven to support rectification processes, particularly, air separation on nitrogen-rich and oxygen-rich streams. Bennett et al., U.S. Pat. No. 5,305,610, Apr. 26, 1994, provides a vortex tube process for producing nitrogen and oxygen. G. I. Voronin et al., "Process and Apparatus for Producing Nitrogen and Oxygen," U.S. Pat. No. 4,531,371, Jul. 30, 1985; D. L. Bennett et al., "Process and Apparatus for Producing Nitrogen and Oxygen"; and V. Balepin, Ph. Ngendakumana, and S. Gauthy, "Air Separation with the Vortex Tube: New Experimental Results," AIAA-98-1627, 1998. Representative additional patents include U.S. Pat. Nos. 1,952,281; 3,546,891; and 6,936,230.

BRIEF SUMMARY

This summary is provided to introduce a selection of concepts in a simplified form that are further described below in the detailed description. This summary is not intended to identify required or essential features of the claimed subject matter, nor is this summary intended to be used to limit the scope of the claimed subject matter.

The disclosure relates to systems and methods for vortex tube separation of mixtures of miscible liquids. In some embodiments, the disclosure provides methods of vortex tube desulfurization (VTDS) of jet fuels.

Methods disclosed herein comprise vortex tube (VT) separation of a two-phase or superheated parent fuel stream into two streams: a primary stream containing a majority of the fuel and a substantially reduced amount of sulfur compounds; and a secondary stream that contains a small amount of the heavy fuel fractions and a majority of the sulfur compounds. For better sulfur recovery and to reduce fuel reformulation, both the primary stream and the secondary stream can be further processed in two-stage or three-stage vortex tube arrangements. VTDS apparatus and methods have advantages of no moving parts, no dependency on gravity, no catalyst, no adsorbent beds, and no consumables.

These systems can provide cleaner fuel with reduced system cost (fuel and power) and reformulation requirements, when compared to conventional methods.

Methods disclosed herein comprising use of vortex tubes for fuel desulfurization are scalable and can be utilized in mobile, portable, or stationary applications. For example, mobile applications include desulfurization of jet fuel for fuel-cell auxiliary power units for trucks and airplanes. Portable applications include small fuel-cell-based generator sets including 1 kW to 3 kW military generators. On-site applications include desulfurization of the heating oil for residential fuel-cell applications, and stationary applications include use in oil refinery processes; for example, use as an initial step of the refinery process in order to reduce facility CAPEX, OPEX and footprint. Specifically, VTDS can be very useful as an initial step of the heavy oil refinery, where on-site processing favors small footprint equipment.

Processes for vortex tube separation of closely boiling species in a mixture of miscible fluids are provided. One application is the removal of sulfur compounds from jet fuel.

The following explains VT configuration and processes of jet fuel desulfurization in the vortex tube.

DETAILED DESCRIPTION

Figure 1:
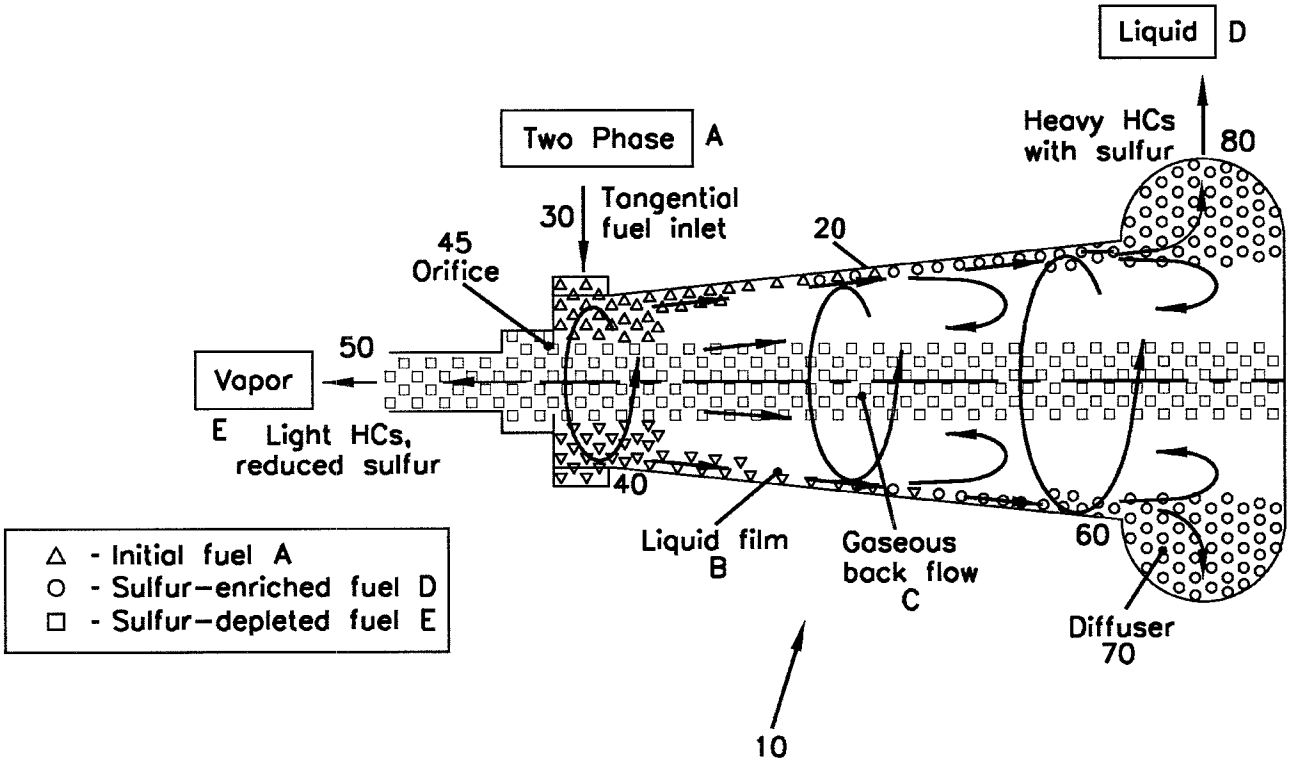
FIG. 1 is a schematic view showing a single-stage vortex tube separator for fuel desulfurization in an embodiment of the disclosure.

The following detailed description refers to the accompanying drawings. Wherever possible, the same or similar reference numbers are used in the drawings and the following description to refer to the same or similar elements. While embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the scope of the disclosure.

Efficient, economical methods for separation of closely boiling species from a mixture of miscible fluids are provided.

Examples of mixtures of miscible fluids for separation include jet fuel, where the high boiling point species comprises undesirable refractory sulfur compounds; water/ethanol mixtures, where ethanol is a product species and water is an undesirable high boiling point species; water/methanol mixtures where methanol is a product species and water is an undesirable high boiling point species; and heavy oil, where product species comprises light fractions and undesirable high boiling point species comprise heavy fractions. Additional mixtures contemplated as appropriate for vortex tube separation include, but are not limited to, 1,3-butadiene/vinyl acetylene, vinyl acetate/ethyl acetate, o-xylene/m-xylene, isopentane/n-pentane, isobutane/n-butane, ethylbenzene/styrene, propylene/propane, methanol/ethanol, water/acetic acid, ethylene/ethane, acetic acid/acetic anhydride, toluene/ethylbenzene, propyne/1,3 butadiene, ethanol/water, isopropanol/water, benzene/toluene, methanol/water, cumene/phenol, formaldehyde/methanol, benzene/ethylbenzene, HCN/water, ethylene oxide/water, water/ethylene glycol, and water/hydrogen peroxide.

A method for separation of a mixture of miscible fluids is provided, where the method comprises introducing a pressurized and heated parent stream of the mixture into a first vortex tube at a tangential inlet, wherein the vortex tube comprises an axial primary outlet at an inlet end, and a secondary outlet at an opposing end; withdrawing a predominantly vapor primary stream depleted in high boiling species from the primary outlet; and removing a predominantly liquid secondary stream enriched with high boiling species from the secondary outlet.

In some embodiments, methods are provided for separation of undesirable refractory sulfur compounds from jet fuel. Proposed vortex tube desulfurization (VTDS) methods favor relatively low inlet pressure, compared to conventional HDS processes.

In some embodiments, a method for jet fuel desulfurization is provided, where the method comprises introducing a pressurized and heated parent stream of the jet fuel into a first vortex tube at a tangential inlet, wherein the vortex tube comprises an axial primary outlet at an inlet end, and a secondary outlet at an opposing end; withdrawing a predominantly vapor primary stream depleted in high boiling sulfur compound species from the primary outlet; and removing a predominantly liquid secondary stream enriched with high boiling sulfur compound species from the secondary outlet.

In some embodiments, a method to further reduce sulfur compound concentration in the primary stream depleted in sulfur compound species withdrawn from the first stage vortex tube is provided comprising further treating the primary stream in a second stage A vortex tube with optional interstage heating. In other embodiments, the primary stream depleted in sulfur compound species withdrawn from the first stage vortex tube is subjected to a polishing process using traditional desulfurization methods such as HDS.

In some embodiments, a method to minimize fuel reformulation of desulfurized jet fuel is provided, the method comprising a step wherein the secondary stream from the first vortex tube enriched with high boiling sulfur compounds is treated in a second stage B vortex tube or subjected to traditional methods of desulfurization such as HDS.

In some embodiments, the method for jet fuel desulfurization includes introducing a pressurized and heated parent stream of the jet fuel into a first vortex tube at a tangential inlet, wherein the vortex tube comprises an axial primary outlet at an inlet end, and a secondary outlet at an opposing end; withdrawing a predominantly vapor primary stream depleted in high boiling sulfur compound species from the primary outlet; removing a predominantly liquid secondary stream enriched with high boiling sulfur compound species from the secondary outlet; directing the primary stream into a second stage A vortex tube via a tangential inlet; withdrawing a product stream from the second stage A vortex tube by means of a primary outlet; and discharging a first recycling stream from the second stage A vortex tube by means of a secondary outlet; wherein the product stream comprises high boiling sulfur compound species-depleted fluid, and the first recycling stream comprises high boiling sulfur compound species-enriched fluid, compared to the primary stream.

In some embodiments, the pressurized and heated stream is pressurized in the range of about 2-6 bars. In some embodiments, the pressurized and heated parent stream is heated to achieve 80-100% of the vapor content. In some embodiments, the pressurized and heated parent stream is heated to achieve a two-phase state at 80% up to 100% of the vapor content. In some embodiments, the pressurized and heated parent stream is heated to achieve a two-phase state to 80% to 90% of the vapor content. In some embodiments, the pressurized and heated parent stream is heated to a temperature in the range of 200° C. to 300° C. In some embodiments, the pressurized and heated parent stream is heated to a temperature in the range of 200° C. to 400° C.

In some embodiments, the heated parent stream is heated to a first temperature within or above the boiling point range of the mixture.

In some embodiments, a method for jet fuel desulfurization is provided, wherein the jet fuel is selected from the group consisting of Jet A, Jet A-1, Jet B, kerosene no. 1-K, JP-4, JP-5, JP-8, and JP-8+100.

In some embodiments, the sulfur compound to be removed from the jet fuel is selected from one or more of benzothiophene, alkyl benzothiophenes, dibenzothiophene, and alkyl dibenzylthiophenes. In some embodiments, the sulfur compound to be removed from the jet fuel alkyl benzothiophenes is selected from one or more of 2-methylbenzothiophene, 3-methylbenzothiophene, 5-methylbenzothiophene, 2,3-dimethylbenzothiophene, 2,3,7-trimethyl benzothiophene, 2,3,5-trimethyl benzothiophene, and 2,3,6-trimethyl benzothiophene.

Predicted results are shown in Table 1 for a prophetic single-stage VTDS, as shown in FIG. 1. Under near optimal conditions, the sulfur-depleted primary fuel stream accounts for 95% of the parent fuel stream, and it is predicted that about 90% of the sulfur compounds can be extracted from the initial 600 ppm level for a fuel such as JP-8. A summary of the prophetic percentage of fuel streams and sulfur distribution is shown in Table 1.

TABLE 1

Effect of removing 5% of the fuel in the VT Separator.

| Stream | % Fuel | Sulfur Content, ppm |
|---|---|---|
| Parent Fuel Stream | 100 | 600 |
| Primary Stream | 95 | 63 |
| Secondary Stream | 5 | 10800 |

Figure 2:
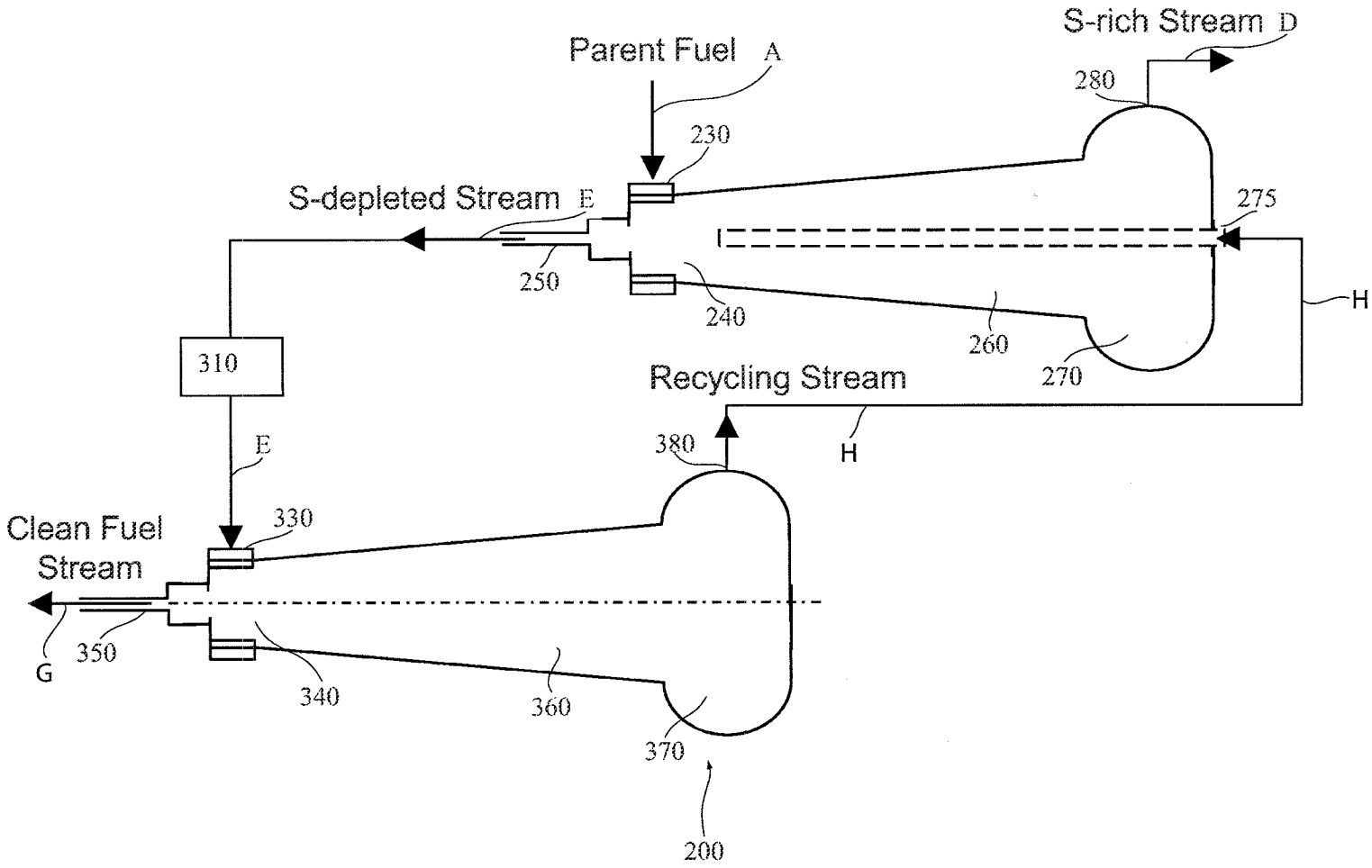
FIG. 2 is a schematic view of a two-stage vortex tube desulfurization process in an embodiment of the disclosure.
Figure 3:
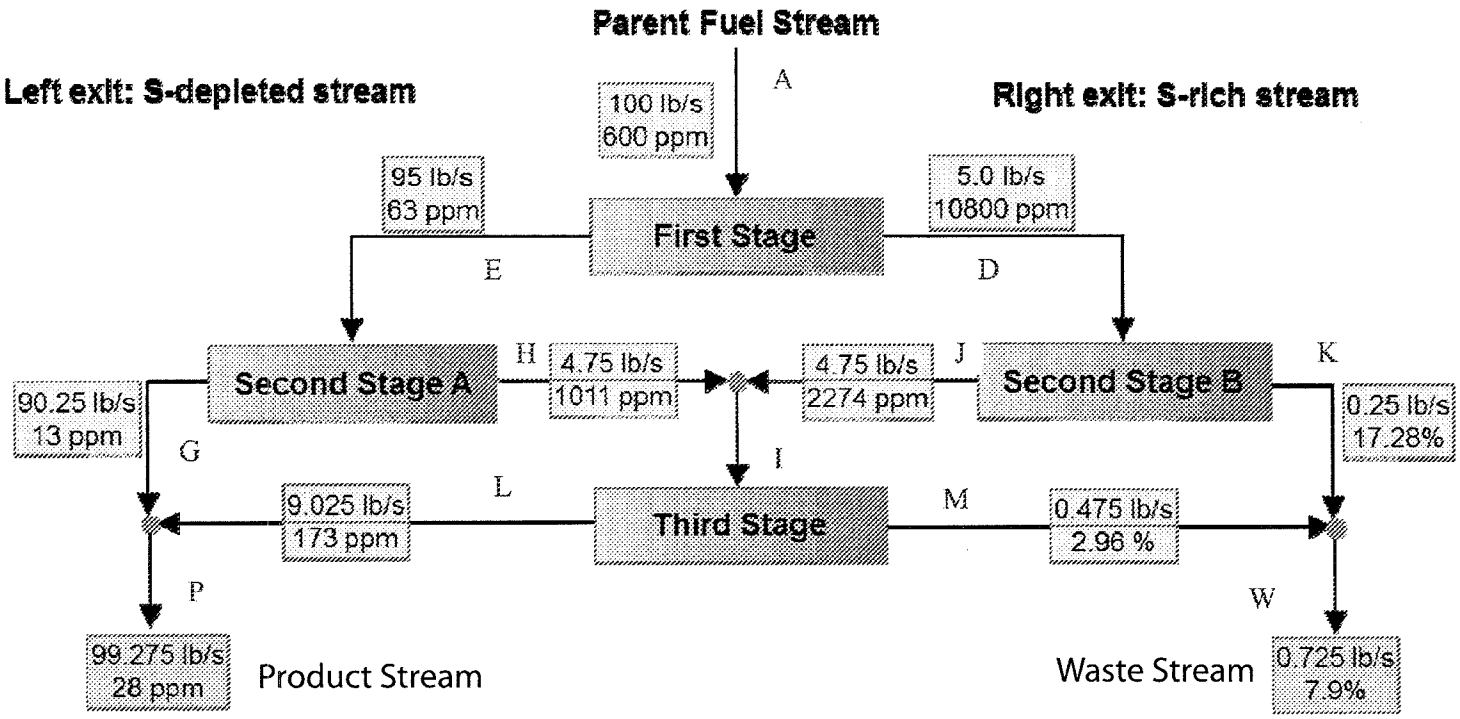
FIG. 3 is a schematic view of a three-stage vortex tube desulfurization process in an embodiment of the disclosure.
Figure 4:
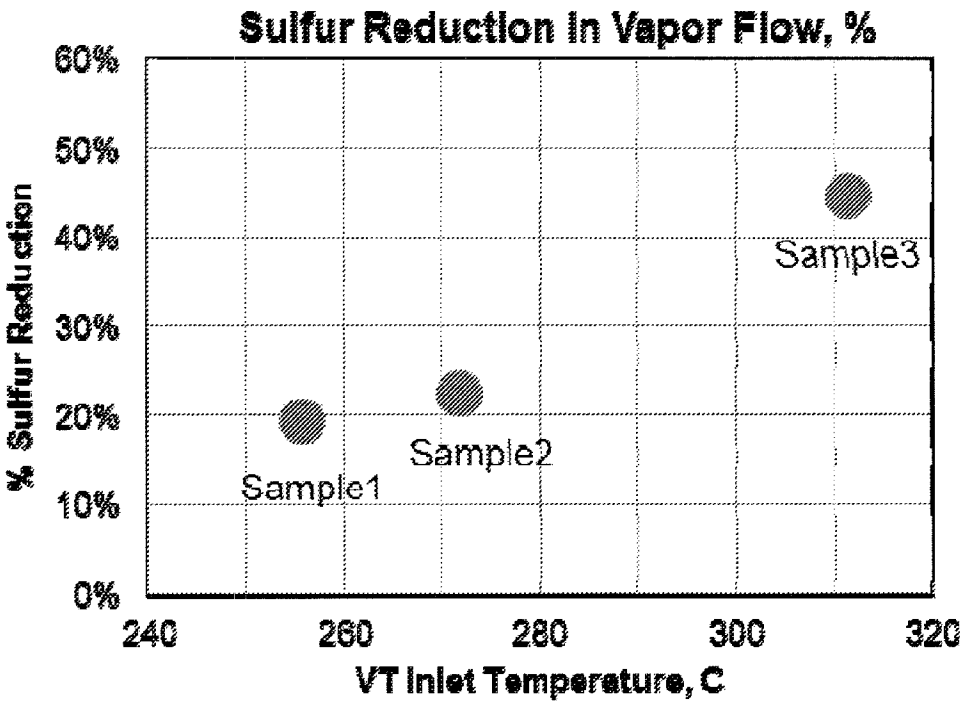
FIG. 4 shows initial test results of a single-stage vortex tube separator with the percentage of sulfur reduction plotted as a function of vortex tube inlet temperature.

Single-stage fuel processor of FIG. 1 can be extended to two-stage and three-stage systems, as shown in FIG. 2 and FIG. 3, respectively.

A single-stage vortex tube separation apparatus 10 in one embodiment of the disclosure is shown in FIG. 1. The VT separator apparatus 10 will be described in the context of separation of a miscible fluid mixture jet fuel. The VT separator apparatus 10 consists of an elongated conical chamber 20 with a tangential inlet 30. The chamber 20 has a constricted end 40 with an orifice 45, an axial vapor stream outlet 50, and an enlarged opposing end 60 with a diffuser 70 and liquid stream outlet 80. In the apparatus 10, the liquid stream outlet 80 may be in a radial, tangential or axial configuration. In alternative embodiments, the vortex tube separator appartus 10 can comprise a cylindrical chamber at 20.

In some embodiments, the VT apparatus 10 of FIG. 1 is employed in a process of desulfurization of jet fuel as follows. Jet fuel parent stream A is pressurized and heated upstream from inlet 30. In some embodiments, fuel at the inlet 30 should be in a two-phase state with at least 80 wt % evaporated or completely evaporated in the expectation of the partial condensation in the VT separator apparatus 10 due to the heat loss. In some embodiments, the parent stream A is pressurized such that an inlet pressure of from 2 bars or greater occurs at inlet 30. In some embodiments, the parent stream A inlet pressure is from 2 bars to 6 bars. The jet fuel parent stream A is also heated upstream from inlet 30 such that the fuel is predominantly or fully evaporated. In some embodiments, the parent stream A is greater than 80% evaporated. In some embodiments, the parent fuel stream A is slightly overheated above the boiling range. In some embodiments, the parent fuel stream A is heated to 200° C. to 400° C., depending on the inlet pressure. The heated, pressurized parent fuel stream A enters the vortex tube 10 at tangential inlet 30.

As shown in FIG. 1, the tangential introduction of the completely or predominantly evaporated fuel A through inlet 30 sets up a two-phase vortex flow consisting of an annular film of liquid B on the chamber wall and a vapor core C. The liquid film B is held on the wall by centrifugal force that far exceeds the effect of gravitational acceleration. As the liquid film B moves from the inlet 30 to the diffuser 70, it exchanges mass with the vapor core C and becomes enriched in lower volatility components, namely, heavy hydrocarbon (heavy HC) and sulfur compounds. This constitutes a purification process distinct from fractional distillation in that the vortex flow speeds up equilibration between vapor and condensate in a reduced volume.

A liquid secondary stream D enriched in heavy HCs and sulfur compounds is withdrawn through the diffuser outlet 80 on the right-hand side of FIG. 1. The sulfur-depleted primary vapor stream E comprising light hydrocarbons and reduced sulfur compound concentration in the core exits axially through the orifice 45 and gas stream outlet port 50 on the left-hand side of FIG. 1. In order to increase sulfur recovery, primary stream E can be further treated in the primary stream second stage vortex tube arrangement as shown in FIG. 2 or may be subjected to polishing processes using traditional desulfurization methods, such as HDS or adsorption methods. Substantially reduced amounts of sulfur will permit a much less complex system, as well as reduce power requirements.

A schematic of a two-stage vortex tube separation apparatus 200 as employed in some embodiments of the disclosure is shown in FIG. 2. Apparatus 200 comprises a first vortex tube 260 and a second vortex tube 360. Each vortex tube in VT separator apparatus 200 consists of an elongated conical chamber with a tangential inlet (230, 330). Each conical chamber has a constricted end (240, 340) with an axial vapor stream outlet (250, 350), and an enlarged opposing end with a diffuser (270, 370) and liquid stream outlet (280, 380). In the apparatus 200, the liquid stream outlets 280, 380 may each individually be in a radial or tangential configuration. In alternative embodiments, one or more vortex tubes in apparatus 200 can comprise a cylindrical chamber at the first vortex tube 260 and/or the second vortex tube 360. The first vortex tube 260 further comprises an elongated axial inlet 275 extending into the vortex tube from the opposing end. Optionally, means 310 for heating sulfur-depleted stream E is inserted between outlet 250 in the first vortex tube 260 and inlet 330 in the second vortex tube 360.

In some embodiments, the apparatus 200 in FIG. 2 is utilized as follows. Jet fuel parent stream A is pressurized and heated upstream from inlet 230. In some embodiments, the parent stream A is pressurized such that an inlet pressure of from 2 bars or greater occurs at inlet 230. In some embodiments, the parent stream A inlet pressure is from 2 bars to 6 bars. In some embodiments, the inlet pressure at inlet 230 is less than 2 bars and pressure downstream of the outlets 250 and 280 is sub-atmospheric. The jet fuel parent stream A is also heated upstream from inlet 230 such that the fuel is predominantly or fully evaporated. In some embodiments, the parent stream A is greater than 80% evaporated. In some embodiments, the jet fuel parent stream A is slightly overheated above the boiling range. In some embodiments, the parent fuel stream A is heated to 200° C. to 400° C., depending on the inlet pressure. The heated, pressurized parent fuel stream A enters the first vortex tube 260 at tangential inlet 230.

As shown schematically in FIG. 2, the tangential introduction of the completely or mostly evaporated fuel A through inlet 230 sets up a two-phase vortex flow consisting of an annular film of liquid on the chamber wall and a vapor core, as described in FIG. 1. A liquid secondary stream D enriched in heavy HCs and sulfur compounds is withdrawn through the diffuser outlet 280 on the right-hand side of FIG. 2. The sulfur-depleted primary vapor stream E comprising light hydrocarbons and reduced sulfur compound concentration in the core exits axially through the gas stream outlet port 250 on the left-hand side of FIG. 2.

As shown schematically in FIG. 2, in order to increase sulfur recovery, primary stream E can be further treated in the primary stream second stage vortex tube 360. Primary stream E is optionally subjected to interstage heating 310, followed by tangential introduction of the completely or mostly evaporated fuel E through inlet 330 in order to set up a two-phase vortex flow consisting of an annular film of liquid on the chamber wall and a vapor core, as described in FIG. 1.

In FIG. 2, a liquid recycling stream H enriched in heavy HCs and sulfur compounds is withdrawn from the second vortex tube 360 through the diffuser outlet 380 on the right-hand side of FIG. 2 and re-introduced to the first vortex tube 260 via the axial inlet 275 extending into the first vortex tube 260. The sulfur-depleted clean fuel vapor stream G comprising light hydrocarbons and further reduced sulfur compound concentration (compared to stream E) exits axially through the gas stream outlet port 350 on the left-hand side of FIG. 2. In order to minimize fuel reformulation, secondary sulfur-rich stream D can also be treated in the secondary stream, second stage vortex tube arrangement, or can be subjected to the different desulfurization methods such as HDS described above. Substantially reduced flow rate (5-10% of the parent fuel stream) will permit a much less complex system and much less power requirements. In some embodiments, after second stage treatment, the sulfur-depleted stream G can be combined with the primary fuel stream E to provide sulfur-depleted fuel with minimal percentage of fuel loss compared to the parent stream.

FIG. 3 shows a schematic of a three-stage VTDS system with theoretical percentages of fuel and sulfur compound content at each stage. In FIG. 3, a theoretical 95%/5% fuel split is assumed for all stages; 90% sulfur removal is assumed for the first and third stages, 80% for the second stage. In one embodiment, if fuel losses are not important (for instance, in a system where significant amounts of the fuel can be used in the sulfur-tolerant combustor), then a two-stage system processing of only S-depleted streams (First Stage and Second Stage A in FIG. 3) is sufficient. Theoretically, two-stage processing can clean 90% of the fuel (versus 99% in the three-stage system), but fuel will be cleaner than in the three-stage system (13 ppm of sulfur compounds vs. 28 ppm).

FIG. 3 shows a theoretical three-stage VTDS system. Parent fuel stream A enters First Stage vortex tube at a typical sulfur compound content for JP-8 of 600 ppm refractory sulfur compounds. The parent stream A is heated and pressurized as described in FIG. 1, and added to First Stage VT by tangential inlet. A sulfur-depleted primary stream E is withdrawn from the primary outlet of First Stage VT with retention of 95 wt % of parent fuel with a reduction in sulfur content of about 90%. Sulfur-enriched secondary stream D is removed from the secondary outlet of First Stage VT and contains 5 wt % of parent fuel with the majority (~90%) of undesirable high boiling sulfur compounds from the parent stream A. Sulfur-depleted primary stream E is directed to Second Stage A VT, with optional interstage heating. A sulfur-depleted product stream G is withdrawn from the primary outlet of Second Stage A VT, with retention of 90 wt % fuel compared to primary stream E, and a reduction in sulfur content of about 80%. A sulfur-enriched first recycling stream H is discharged from secondary outlet of Second Stage A VT with about 5 wt % fuel of primary stream E, and about 80% of sulfur compounds compared to primary stream E. Sulfur-enriched secondary stream D is directed to Second Stage B VT, with optional interstage heating. A sulfur-depleted second recycling stream J is withdrawn from the primary outlet of Second Stage B VT, having about 95 wt % of fuel as secondary stream D, and a reduction in sulfur content of about 80% reduction in sulfur compared to secondary stream D. A sulfur-compound-enriched waste stream K is removed from the secondary outlet of Second Stage B VT. The first recycling stream H and the second recycling stream J are blended to form blended stream I. Blended stream I is subjected to optional interstage heating and is injected to Third Stage VT by a tangential inlet. A sulfur compound-depleted recovery stream L is withdrawn from Third Stage VT by the primary outlet having about 95 wt % fuel compared to blended stream I, and about 86% reduction in sulfur content compared to blended stream I. A sulfur-enriched waste stream M is removed from Third Stage VT by the secondary outlet. The product stream G from the Second Stage A VT and the recovery stream L from the Third Stage VT are blended to create a recovered product stream P having 99 wt % fuel of parent stream A, and 95% reduction of sulfur compounds compared to parent stream A. To recover sulfur compounds, waste stream K from Second Stage B VT and waste stream M from Third Stage VT are blended to create waste stream W, having about 95 wt % of the sulfur compounds of parent stream A.

In some embodiments, the disclosure provides an efficient method for jet fuel desulfurization. In some embodiments, the product fuel does not require reformulation prior to use. In some embodiments, the product fuel is appropriate for fuel cell utilization. In some embodiments, it is contemplated that methods according to the disclosure provide Product Fuel with 90% sulfur reduction or greater compared to Parent Fuel, with less than 10 wt % of sulfur-rich fuel removed.

In some embodiments, a method for separation of a mixture of miscible fluids is provided wherein the mixture is a hydrocarbon fuel. In some embodiments, the hydrocarbon fuel for separation is a jet fuel. In some embodiments, the mixture of miscible fluids for separation is jet fuel for desulfurization. In some embodiments, the jet fuel for desulfurization is selected from the group consisting of 1-K kerosene, Jet A, Jet A-1, Jet B, JP-5, JP-8 and JP-8+100. In some embodiments, the hydrocarbon fuel for desulfurization is JP-8. In some embodiments, the jet fuel for desulfurization is Jet A.

In some embodiments, the jet fuel for desulfurization is JP-8. JP-8 (jet propellant 8, NATO Code No. F-34) is a kerosene-based jet fuel similar to commercial aviation fuel Jet A. JP-8 is widely used by the U.S. military and is specified by MIL-DTL-83133. JP-8+100 (NATO Code No. F-37) is a JP-8 type kerosene turbine fuel that contains thermal stability improver additive (NATO S-1749). JP-8 and kerosene are mixtures of a large number of hydrocarbons that together must meet standardized specifications. JP-8 differs from Jet A and straight-run kerosene due to additives required by the military specification. These include fuel system icing inhibitor, corrosion inhibitor, and static dissipater. JP-8 is composed of hundreds of individual chemicals and their isomers. The chemical composition of JP-8 is not regulated, but the specification limits aromatics to 25%, sulfur to 0.3% (3000 ppmw), and olefins to 5.0%. Aliphatic hydrocarbons make up about 80% of the total. Although the sulfur level in JP-8 can be as high as 3000 ppm, typical ranges are from 400 to 1600 ppmw. Distillation temperature (boiling range) of JP-8 is about 150° C. to about 290° C. Specifications describe 10% recovery at 205° C., with the final boiling point about 300° C. Detail Specification, MIL-DTL-83133H, Sep. 14, 2012.

JP-8 sulfur content is comprised of thiols, sulfides, disulfides, and benzothiophenes. Link et al., 2003, *Energy and Fuels,* 17, 1292-1302. The major sulfur compounds in JP-8 are alkyl sulfur compounds. JP-8 sulfur compounds with boiling points in the jet range are referred to as "refractory sulfur compounds"; these include, for example, benzothiophene, alkylbenzothiophenes, dibenzothiophene and alkyldibenzothiophenes. Mono-, di- and tri-methylbenzothiophenes are particularly prevalent in JP-8. Two major sulfur compounds in JP-8 are 2,3-dimethylbenzothiophene (2,3-DMBT) and 2,3,7-trimethyl-benzothiophene (2,3,7-TMBT). Ma et al. 2003. An efficient method to reduce undesirable refractory sulfur compounds in JP-8 without having to reformulate product fuel is desirable.

In some embodiments, a method to reduce undesirable refractory sulfur compounds in JP-8 without having to reformulate product fuel is provided.

In some embodiments, a method of JP-8 desulfurization is provided in a mobile application for use in fuel cells.

In some embodiments, a method of Jet A desulfurization is provided in a mobile application for use in a fuel-cell APU (auxiliary power unit) of a commercial jet.

DEFINITIONS

The boiling point of a liquid refers to the temperature at which its vapor pressure becomes equal to the ambient pressure. The boiling point range of a non-azeotropic mixture can be determined by the distillation temperature range for a mixture of miscible liquids. The boiling point range, or boiling range, of a mixture is a function of vapor pressures of the various components in the mixture. For example, typical boiling range for JP-8 or JP-5 is about 150-290° C. See online at atsdr.cdc.gov/toxprofiles/tp121-c3.pdf; p. 102, Table 3-4. Specifications for JP-8 require a distillation range of 205° C. at 10% recovered to final boiling point of 300° C. (MIL-DTL-83133H, Oct. 25, 2011).

In the case of an azeotropic mixture, as used herein, the boiling point range is defined as encompassing each of the boiling points of the individual compound species in the mixture and the boiling point of the azeotrope.

In some embodiments, the high boiling species is a component in the mixture of miscible fluids wherein the boiling point of the high boiling species is higher than the midpoint of the boiling point range of the mixture. In some embodiments, the high boiling species is a refractory sulfur compound present in hydrocarbon fuel. In some embodiments, the high boiling species is one or more of an alkyl substituted benzothiophene, or alkyl substituted dibenzothiophene. In some embodiments, the high boiling species is selected from one or more of 2,3-dimethylbenzothiophene, 2,3,7-trimethyl benzothiophene, 2,3,5-trimethyl benzothiophene, 2,3,6-trimethyl benzothiophene, 2-Methylbenzothiophene, 3-Methylbenzothiophene, and 5-Methylbenzothiophene.

Representative refractory sulfur compounds known in JP-8 are shown in Table 2.

TABLE 2

Common Sulfur Compound impurities present in JP-8.

| Compound | boiling point | Hydrocarbon fuel | Reference |
|---|---|---|---|
| 2-Methylbenzothiophene (2-MBT, C2-BT) | 243° C., 760 mmHg | JP-8 | Velu et al., 2003 |
| 2,3-dimethylbenzothiophene (2,3-DMBT) | 268.4° C., 760 mmHg | JP-8 | Ma et al., 2003<br>Velu et al., 2003 |
| 2,3,7-trimethyl benzothiophene (2,3,7-TMBT) | 287° C., 760 mmHg | JP-8 | Ma et al., 2003<br>Velu et al., 2003<br>Sundararaman et al., 2010 |
| 2,3,5-trimethyl benzothiophene (2,3,5-TMBT) | 285.8° C. at 760 mmHg | JP-8 | Song et al., 2003 |
| 2,3,6-trimethyl benzothiophene (2,3,6-TMBT) | 288.1° C. at 760 mmHg | JP-8 | Song et al., 2003 |

EXAMPLES

Example 1

Single-Stage Fuel Desulfurization

A model system applicable to fuel desulfurization under field conditions was set up according to the schematic shown in FIG. 1. The current scale is at approximately 100 KW equivalent amount of fuel; however, the system is scalable. Inlet pressure was 2 bars. JP-8 was used in the initial test runs with a single-stage vortex tube apparatus. The percent reduction sulfur compound concentration (ppm) and the percent removed fuel are shown in Table 3.

TABLE 3

Sulfur Reduction in Vapor Flow*

| Number | $T_{in}$, deg. C. | Sulfur compound concentration, ppm: Parent fuel | Sulfur compound concentration, ppm: Clean fuel | % sulfur reduction | % removed fuel |
|---|---|---|---|---|---|
| 1 | 256 | 697 | 563 | 19% | 13% |
| 2 | 272 | 697 | 542 | 22% | 17% |
| 3 | 311 | 697 | 385 | 45% | 15% |
| Altex fuel processor (fractionation per U.S. Pat. No. 7,303,598) | | | | | |
| Comparative Example | | 736 | 371 | 50% | 30% |

*due to low available heating capacity, flow conditions were not optimum.

Even under suboptimal conditions, the single-stage vortex tube desulfurization system (VTDS) significantly reduced the percentage of fuel lost (heavy ends), when compared to the fractional distillation of comparative example from U.S.

Pat. No. 7,305,598. Target numbers are 90-95% sulfur reduction at 5-10% sulfur-rich fuel removed.

While certain embodiments of the disclosure have been described, other embodiments may exist. Further, any disclosed methods' stages may be modified in any manner, including by reordering stages and/or inserting or deleting stages, without departing from the disclosure. While the specification includes examples and representative drawings, the disclosure's scope is indicated by the appended claims. Furthermore, while the specification has been described in language specific to structural features and/or methodological acts, the claims are not limited to the features or acts described above. Rather, the specific features and acts described above are disclosed as illustrative embodiments of the disclosure.

REFERENCES CITED

Bartholomew, C. H. and Farrauto, Robert J., "Fundamentals of Industrial Catalytic Processes," Wiley, John & Sons, Inc., 2005. Ch. 9.

Namazian, M. and Kelly, J., "Liquid Fuel Preprocessor," U.S. Pat. No. 7,303,598, Dec. 4, 2007.

Voronin, G. I., et al., "Process and Apparatus for Producing Nitrogen and Oxygen," U.S. Pat. No. 4,531,371, Jul. 30, 1985.

Bennett, D. L., et al, "Process and Apparatus for Producing Nitrogen and Oxygen," U.S. Pat. No. 5,305,610, Apr. 26, 1994.

Balepin, V., Ngendakumana, P., and Gauthy, S., "Air Separation with the Vortex Tube: New Experimental Results," AIAA-98-1627, 1998.

Fekete, "Vortex Tube Process and Apparatus," U.S. Pat. No. 3,546,891, Dec. 15, 1970.

Ma et al., "Adsorptive desulfurization of JP-8 jet fuel and its light fraction over nickel-based adsorbants for fuel cell applications." Prep. Pap, *Am. Chem. Soc. Div. Fuel Chem.*, 2003, 48(2), 688.

Zhurin et al., "System for thermal and catalytic fuel cracking of crude oil," U.S. Pat. No. 6,936,230, Aug. 30, 2005.

Detail Specification, Turbine Fuel, Aviation, Kerosene Type, JP-8 (NATO F-34), JP-A1 (NATO F-35), and JP-8+100 (NATO F-37) MIL-DTL-83133H, Oct. 25, 2011.

Velu et al., "Selective adsorption for removing sulfur from jet fuel over zeolite-based adsorbants." *Ind. Eng. Chem. Res.* 2003, 42(21):5293-5304.

Velu et al., "Desulfurization of JP-8 jet fuel by selective adsorption over a Ni-based adsorbant for micro solid oxide fuel cells." *Energy & Fuels*, 2005, 19, 1116-1125.

Sundararaman et al., "Oxidative desulfurization of jet and diesel fuels using hydroperoxide generated in situ by catalytic air oxidation." *Ind. Eng. Chem. Res.* 2010, 49(12): 5561-5568.

Song et al., New design approaches to ultra-clean diesel fuels by deep desulfurization and deep aromatization. " *Appl. Cat. B: Environ.* 41 (2003) 207-238.

We claim:

1. A method for separating at least one sulfur-containing compound from a hydrocarbon-based fuel, the method comprising:

introducing a pressurized and heated parent stream comprising a mixture of the at least one sulfur-containing compound and the hydrocarbon-based fuel into a first vortex tube at a tangential inlet, the first vortex tube comprising an axial primary outlet at an inlet end and a secondary outlet at an opposing end;

withdrawing a predominantly vapor primary stream from the primary outlet, the primary stream comprising a lower concentration of the at least one sulfur-containing compound than the parent stream; and removing a predominantly liquid secondary stream from the secondary outlet, the secondary stream comprising a higher concentration of the at least one sulfur-containing compound than the parent stream.

2. The method of claim 1, wherein the pressurized and heated parent stream is in a two-phase state that is at least predominantly gaseous.

3. The method of claim 2, wherein at least 80 wt % of the pressurized and heated parent stream is gaseous.

4. The method of claim 1, wherein the pressurized and heated parent stream enters the first vortex tube at a first temperature within or above a boiling point range of the mixture.

5. The method of claim 1, wherein the secondary outlet is radial, tangential or axial.

6. The method of claim 1, wherein the hydrocarbon-based fuel comprises jet fuel.

7. The method of claim 6, wherein the jet fuel is selected from the group consisting of Jet A, Jet A-1, Jet B, kerosene no. 1-K, JP-4, JP-5, JP-8, and JP-8+100.

8. The method of claim 1, wherein an inlet pressure is at least 2 bars.

9. The method of claim 1, wherein an inlet pressure is less than 2 bars and pressures downstream of each of the primary outlet and the secondary outlet are sub-atmospheric.

10. The method of claim 1, wherein the secondary stream removed from the secondary outlet comprises from about 1 wt % to about 20 wt % of the parent stream.

11. The method of claim 1, wherein the pressurized and heated parent stream enters the first vortex tube at a temperature in a range from about 200° C. to about 400° C.

12. The method of claim 1, wherein a concentration of the at least one sulfur-containing compound in the primary stream is reduced by at least 20% compared to a concentration of the at least one sulfur-containing compound in the parent stream.

13. The method of claim 12, wherein the concentration of the at least one sulfur-containing compound in the primary stream is reduced by at least 40% compared to the concentration of the at least one sulfur-containing compound in the parent stream.

14. The method of claim 1, wherein the at least one sulfur-containing compound is selected from the group consisting of benzothiophene, alkyl benzothiophenes, dibenzothiophene, and alkyl dibenzylthiophenes.

15. The method of claim 14, wherein the at least one sulfur-containing compound is selected from the group consisting of 2-methylbenzothiophene, 3-methylbenzothiophene, 5-methylbenzothiophene, 2,3-dimethylbenzothiophene, 2,3,7-trimethyl benzothiophene, 2,3,5-trimethyl benzothiophene, and 2,3,6-trimethyl benzothiophene.

16. The method of claim 1, further comprising:

directing the primary stream into a second stage A vortex tube at a tangential inlet proximal to a first end thereof, the second stage A vortex tube comprising an axial primary outlet at the first end and a secondary outlet at a second end distal to the first end;

removing a product stream from the second stage A vortex tube through the primary outlet thereof; and removing a first recycling stream from the second stage A vortex tube through the secondary outlet thereof;

wherein the product stream comprises a lower concentration of the at least one sulfur-containing compound than the primary stream and the first recycling stream comprises a higher concentration of the at least one sulfur-containing compound than the primary stream.

17. The method of claim 16, further comprising heating at least a portion of the primary stream to a second temperature prior to directing the primary stream into the second stage A vortex tube.

18. The method of claim 16, further comprising reintroducing the first recycling stream to the first vortex tube.

19. The method of claim 18, wherein reintroducing the first recycling stream to the first vortex tube comprises passing the first recycling stream through an axial inlet extending into the first vortex tube at the second end thereof.

20. The method of claim 16, further comprising:

directing the secondary stream into a second stage B vortex tube at a tangential inlet proximal to a first end thereof, the second stage B vortex tube comprising an axial primary outlet at the first end and a secondary outlet at a second end distal to the first end;

removing a second recycling stream from the second stage B vortex tube through the primary outlet thereof; and removing a waste stream from the second stage B vortex tube through the secondary outlet thereof;

wherein the second recycling stream comprises a lower concentration of the at least one sulfur-containing compound than the secondary stream and the waste stream comprises a higher concentration of the at least one sulfur-containing compound than the secondary stream.

21. The method of claim 20, further comprising:

blending the second recycling stream with the first recycling stream to create a blended stream;

directing the blended stream into a third stage vortex tube via an inlet proximal to a first end thereof, the third stage vortex tube comprising an axial primary outlet at the first end and a secondary outlet at a second end distal to the first end;

removing a recovery stream from the third stage vortex tube through the primary outlet thereof; and removing a waste stream from the third stage vortex tube through the secondary outlet thereof;

wherein the recovery stream comprises a lower concentration of the at least one sulfur-containing compound than the blended stream and the waste stream comprises a higher concentration of the at least one sulfur-containing compound than the blended stream.

22. The method of claim 21, further comprising mixing the recovery stream with the product stream to provide a recovered product stream, wherein the recovered product stream comprises a lower concentration of the at least one sulfur-containing compound than the primary stream.

* * * * *